US009020821B2

(12) United States Patent
Nishiyama

(10) Patent No.: US 9,020,821 B2
(45) Date of Patent: Apr. 28, 2015

(54) APPARATUS AND METHOD FOR EDITING SPEECH SYNTHESIS, AND COMPUTER READABLE MEDIUM

(75) Inventor: Osamu Nishiyama, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 200 days.

(21) Appl. No.: 13/235,656

(22) Filed: Sep. 19, 2011

(65) Prior Publication Data

US 2012/0239404 A1 Sep. 20, 2012

(30) Foreign Application Priority Data

Mar. 17, 2011 (JP) ..... P2011-059560

(51) Int. Cl.
*G10L 13/033* (2013.01)
*G10L 13/08* (2013.01)

(52) U.S. Cl.
CPC ..... *G10L 13/033* (2013.01); *G10L 13/08* (2013.01)

(58) Field of Classification Search
USPC ..... 704/258, 260, 265
See application file for complete search history.

(56) References Cited

U.S. PATENT DOCUMENTS 3,059,348 A * 10/1962 Mezzacappa ..... 434/320
3,765,106 A * 10/1973 Cornell, III ..... 434/320
3,911,494 A * 10/1975 Wilson et al. ..... 360/92.1
5,020,108 A * 5/1991 Wason ..... 704/226
5,490,234 A * 2/1996 Narayan ..... 704/260
5,791,916 A * 8/1998 Schirbl et al. ..... 439/76.1
5,796,916 A * 8/1998 Meredith ..... 704/258
6,529,874 B2 * 3/2003 Kagoshima et al. ..... 704/269
7,031,924 B2 * 4/2006 Kimura et al. ..... 704/274
7,761,301 B2 * 7/2010 Xu ..... 704/260
2006/0143012 A1 * 6/2006 Kimura et al. ..... 704/260
2008/0109225 A1 * 5/2008 Sato ..... 704/260
2009/0254349 A1 * 10/2009 Hirose et al. ..... 704/260
2011/0238420 A1 * 9/2011 Hirabayashi et al. ..... 704/260
2012/0046949 A1 * 2/2012 Leddy et al. ..... 704/260

FOREIGN PATENT DOCUMENTS

JP 11-095783 4/1999
JP 2005-345699 12/2005

* cited by examiner

*Primary Examiner* — Richemond Dorvil
*Assistant Examiner* — Seong-Ah A. Shin
(74) *Attorney, Agent, or Firm* — Amin, Turocy & Watson, LLP

(57) ABSTRACT

An acquisition unit analyzes a text, and acquires phonemic and prosodic information. An editing unit edits a part of the phonemic and prosodic information. A speech synthesis unit converts the phonemic and prosodic information before editing the part to a first speech waveform, and converts the phonemic and prosodic information after editing the part to a second speech waveform. A period calculation unit calculates a contrast period corresponding to the part in the first speech waveform and the second speech waveform. A speech generation unit generates an output waveform by connecting a first partial waveform and a second partial waveform. The first partial waveform contains the contrast period of the first speech waveform. The second partial waveform contains the contrast period of the second speech waveform.

8 Claims, 16 Drawing Sheets

APPARATUS AND METHOD FOR EDITING SPEECH SYNTHESIS, AND COMPUTER READABLE MEDIUM

CROSS-REFERENCE TO RELATED APPLICATION

This application is based upon and claims the benefit of priority from Japanese Patent Application No. 2011-059560, filed on Mar. 17, 2011; the entire contents of which are incorporated herein by reference.

FIELD

Embodiments described herein relate generally to an apparatus and a method for editing speech synthesis, and a computer readable medium for causing a computer to perform the method.

BACKGROUND

Recently, an apparatus for editing speech synthesis is proposed. As to the apparatus, first, a user directly edits phonemic and prosodic information acquired by analyzing a text. After editing, the apparatus converts the phonemic and prosodic information to a speech waveform. In this apparatus, in order to support the user's editing work, the user's editing history for phonemic and prosodic information such as a reading sign, a prosodic sign and synthesized speech control information (fundamental frequency, phoneme, duration), is stored. By using this editing history, a speech waveform before editing is appeared again.

When an accent phrase of some text is edited, in above-mentioned technique, first, phonemic and prosodic information before editing is converted to a speech waveform, and listened by a user. After editing, the phonemic and prosodic information edited is converted to a speech waveform, and listened by the user. In this way, as to the conventional technique, the user listens to a speech waveform of phonemic and prosodic information before editing, edits the phonemic and prosodic information, and listens to a speech waveform of the phonemic and prosodic information edited. Accordingly, it is difficult for the user to correctly confirm a difference of the speech waveform occurred by editing.

DETAILED DESCRIPTION

According to one embodiment, an apparatus for editing speech synthesis includes an acquisition unit, an editing unit, a speech synthesis unit, a period calculation unit, and a speech generation unit. The acquisition unit is configured to analyze a text, and to acquire a phonemic and prosodic information to synthesize a speech corresponding to the text. The editing unit is configured to edit at least a part of the phonemic and prosodic information. The speech synthesis unit is configured to convert the phonemic and prosodic information before editing the part to a first speech waveform, and to convert the phonemic and prosodic information after editing the part to a second speech waveform. The period calculation unit is configured to calculate a contrast period of the first speech waveform and the second speech waveform respectively. The contrast period corresponds to the part in the phonemic and prosodic information. The speech generation unit is configured to generate an output waveform by connecting a first partial waveform and a second partial waveform. The first partial waveform contains the contrast period of the first speech waveform. The second partial waveform contains the contrast period of the second speech waveform.

Various embodiments will be described hereinafter with reference to the accompanying drawings.

The First Embodiment

As to an apparatus for editing speech synthesis according to the first embodiment, in case of text-to-speech synthesis, phonemic and prosodic information (acquired by analyzing a text) is interactively edited. In this apparatus, a first speech waveform is generated from phonemic and prosodic information of pre-editing (before editing), and a second speech waveform is generated from the phonemic and prosodic information of post-editing (after editing). Then, by connecting a first partial waveform corresponding to a partial sequence (editing target) of the phonemic and prosodic information to a second partial waveform corresponding to the partial sequence, a third speech waveform is generated, and reproduced from a speaker. In this way, by using the third speech waveform, two speech waveforms of pre-editing and post-editing are continually reproduced. Accordingly, a user can correctly confirm a difference between the two speech waveforms.

(The Whole Block Component)

Figure 1:
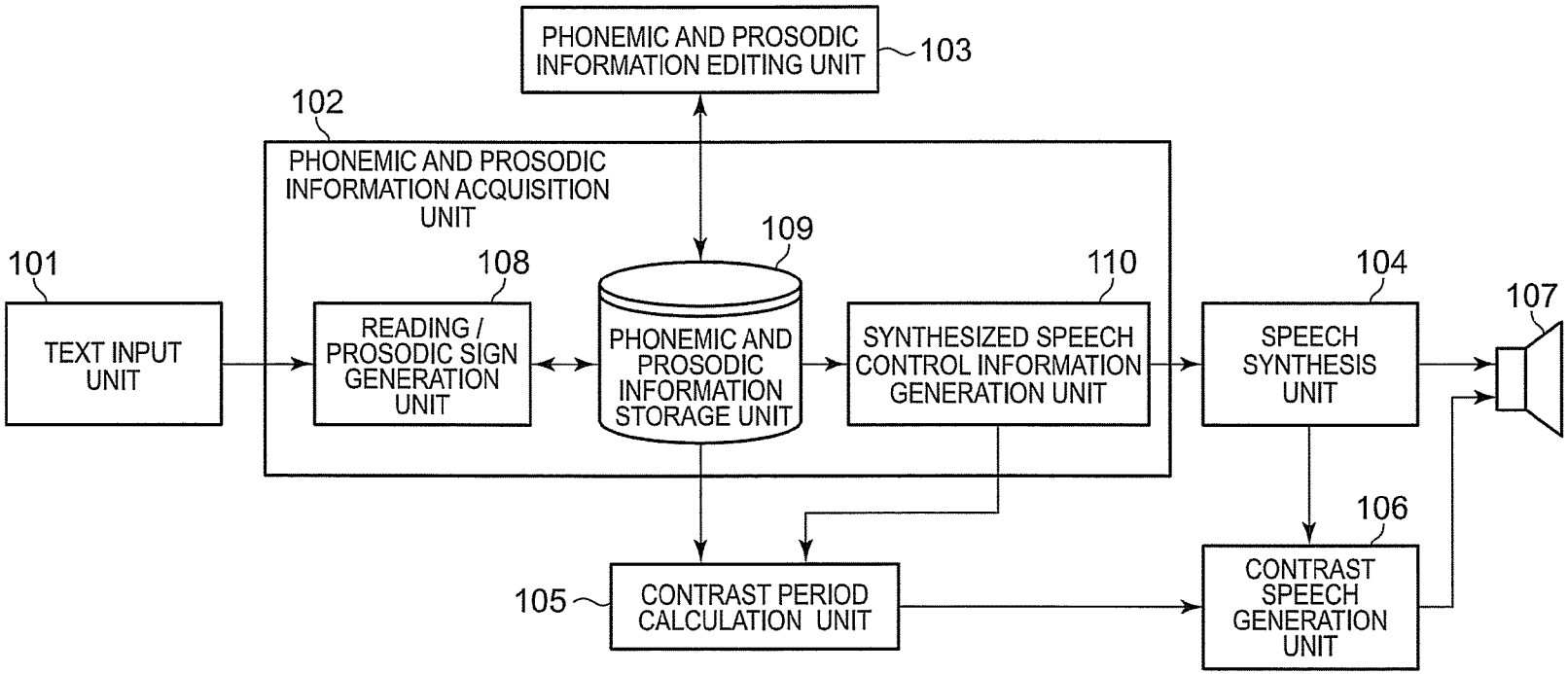
FIG. 1 is a block diagram of an apparatus for editing speech synthesis according to the first embodiment.

FIG. 1 is a block diagram of the apparatus according to the first embodiment. The apparatus includes a text input unit 101, a phonemic and prosodic information acquisition unit 102, a phonemic and prosodic information editing unit 103, a speech synthesis unit 104, a contrast period calculation unit 105, a contrast speech generation unit 106, and a speaker 107.

The text input unit 101 inputs a text. The phonemic and prosodic information acquisition unit 102 analyzes the text (input to the text input unit 101), and acquires phonemic and prosodic information to synthesize a speech. The phonemic and prosodic information editing unit 103 edits the phonemic and prosodic information (acquired by the phonemic and prosodic information acquisition unit 102). The speech synthesis unit 104 converts the phonemic and prosodic information of pre-editing and post-editing to first and second speech waveforms respectively. The contrast period calculation unit 105 calculates a contrast period of the first and second speech waveforms corresponding to a partial sequence (edited by the phonemic and prosodic information editing unit 103) in the phonemic and prosodic information. The contrast speech generation unit 106 generates a third speech waveform by connecting a partial waveform (including the contrast period) of the first speech waveform to a partial waveform (including the contrast period) of the second speech waveform. The speaker 107 reproduces the third speech waveform.

The phonemic and prosodic information acquisition unit 102 includes a reading/prosodic sign generation unit 108, a phonemic and prosodic information storage unit 109, and a synthesized speech control information generation unit 110.

The reading/prosodic sign generation unit 108 analyzes a text (input to the text input unit 101), and generates reading sign and prosodic sign (Hereinafter, they are called "reading/prosodic sign). The phonemic and prosodic information storage unit 109 stores reading/prosodic sign generated by the reading/prosodic sign generation unit 108. The synthesized speech control information generation unit 110 analyzes the reading/prosodic sign (stored in the phonemic and prosodic information storage unit 109), and generates synthesized speech control information such as a duration and a fundamental frequency.

(Hardware Component)

Figure 2:
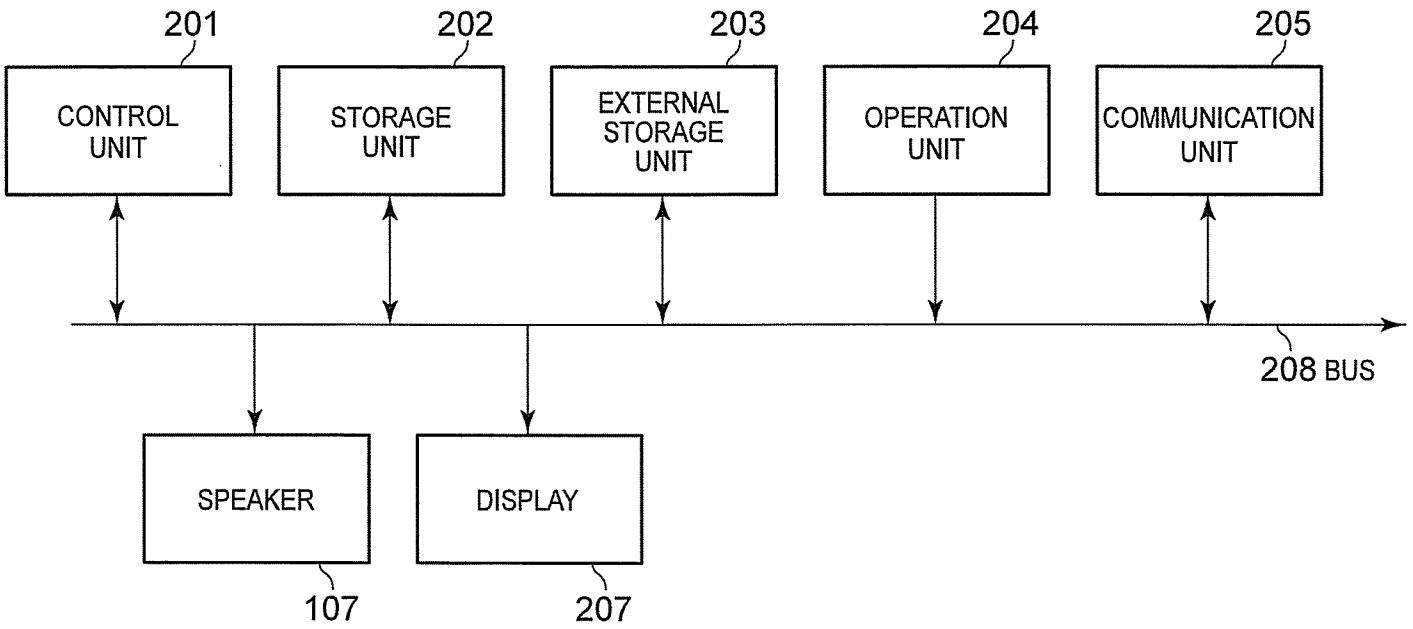
FIG. 2 is a hardware component of the apparatus in FIG. 1.

The apparatus of the first embodiment is composed by a hardware using a regular computer shown in FIG. 2. This hardware includes a control unit 201 such as a CPU (Central Processing Unit) to control the entire apparatus, a storage unit 202 such as a ROM (Read Only Memory) or a RAM (Random Access Memory) to store various kinds of data and program, an external storage unit 203 such as a HDD (Hard Access Memory) or a CD (Compact Disk) to store various kinds of data or program, an operation unit 204 such as a keyboard or a mouse to accept a user's indication, the speaker to generate a reproduction speech by reproducing a speech waveform, a display 207 to display a video, and a bus 208 to connect them.

In such hardware component, the control unit 201 executes various programs stored in the storage unit 202 (such as the ROM) and the external storage unit 203. As a result, following functions are realized.

(The Text Input Unit)

The text input unit 101 inputs a text as a synthesis target via the operation unit 204 such as the keyboard.

(The Phonemic and Prosodic Information Acquisition Unit)

The phonemic and prosodic information acquisition unit 102 analyzes a text (input to the text input unit 101), and acquires phonemic and prosodic information. The phonemic and prosodic information relates to a phoneme and prosody necessary for generating a speech waveform by the speech synthesis unit 104. In the first embodiment, this information represents reading/prosodic sign information and synthesized speech control information generated by the reading/prosodic sign generation unit 108 and the synthesized speech control information generation unit 110 respectively (explained afterwards).

(The Phonemic and Prosodic Information Editing Unit)

The phonemic and prosodic information editing unit 103 edits phonemic and prosodic information (acquired by the phonemic and prosodic information acquisition unit 102) via a user interface on the display 207. In the first embodiment, a user can edit reading/prosodic sign information among the phonemic and prosodic information. Moreover, when the reading/prosodic sign information is edited, the user may freely edit a text via a keyboard of the operation unit 204. Alternatively, the user may select a next candidate of the reading/prosodic sign information presented by the apparatus.

(The Speech Synthesis Unit)

The speech synthesis unit 104 generates a speech waveform from phonemic and prosodic information of pre-editing and post-editing in the phonemic and prosodic information editing unit 103. Concretely, phonemic and prosodic information of pre-editing is converted to a first speech waveform, and phonemic and prosodic information of post-editing is converted to a second speech waveform.

(The Contrast Period Calculation Unit)

The contrast period calculation unit 105 specifies a partial sequence of phonemic and prosodic information (as an editing target of the phonemic and prosodic information editing unit 103), and calculates a contrast period of the first and second speech waveforms corresponding to the partial sequence. The contrast period specifies a speech waveform corresponding to the partial sequence (the editing target) in the phonemic and prosodic information. For example, the contrast period is "a period between $0_{msec}$ and $100_{msec}$ in the speech waveform". When the contrast period is calculated from the partial sequence, a duration acquired by the synthesized speech control information generation unit 110 (explained afterwards) is used. Concretely, by assigning the duration to the reading/prosodic sign information, a start position and an end position of the speech waveform corresponding to the partial sequence (the editing target) is specified.

(The Contrast Speech Generation Unit)

The contrast speech generation unit 106 generates a third speech waveform by connecting a first partial waveform including the contrast period of the first speech waveform (calculated by the contrast period calculation unit 105) to a second partial waveform including the contrast period of the second speech waveform (calculated by the contrast period calculation unit 105) For example, if the contrast period of the first speech waveform is between $0_{msec}$ and $100_{msec}$ the first partial waveform represents a speech waveform extracted from a period including between $0_{msec}$ and $100_{msec}$. Furthermore, when the first partial waveform is connected to the second partial waveform, a silent period approximately having $500_{msec}$ may be included between the first and second waveforms. In this way, the third speech waveform is generated by continually connecting a partial waveform of pre-editing to a partial waveform of post-editing. As a result, the contrast speech generation unit 106 can continually output partial waveforms of pre-editing and post-editing. Accordingly, the user can correctly understand a difference of speech waveforms occurred by editing.

The contrast speech generation unit 106 may continually output the first partial waveform (extracted from the first speech waveform) and the second partial waveform (extracted from the second speech waveform) to the speaker 107 without generation of the third speech waveform. In this case, by inserting the silent period having a specific length between the first and second partial waveforms, they may be output to the speaker 107. Next, each unit composing the phonemic and prosodic information acquisition unit 102 is explained.

(The Reading/Prosodic Sign Generation Unit)

The reading/prosodic sign generation unit 108 performs morphological analysis/syntactical analysis/pose length estimation to a text (input to the text input unit 101), generates reading/prosodic sign information of each prosodic control unit. The reading/prosodic sign information includes a reading, a position/strength of accent core, and a position/length of pose. The prosodic control unit represents a unit segmented by a boundary of accent phrase.

(The Phonemic and Prosodic Information Storage Unit)

The phonemic and prosodic information storage unit 109 stores reading/prosodic sign information generated by the reading/prosodic sign generation unit 108 and reading/prosodic sign information edited by the phonemic and prosodic information editing unit 103 (explained afterwards). As the phonemic and prosodic information storage unit 109, the storage unit 202 and the external storage unit 203 can be used.

(The Synthesized Speech Control Information Generation Unit 110)

The synthesized speech control information generation unit 110 analyzes the reading/prosodic sign (stored in the phonemic and prosodic information storage unit 109), and calculates synthesized speech control information of each prosodic control unit. The synthesized speech control information includes duration and fundamental frequency of the reading/prosodic sign information.

(Flow Chart)

Figure 3:
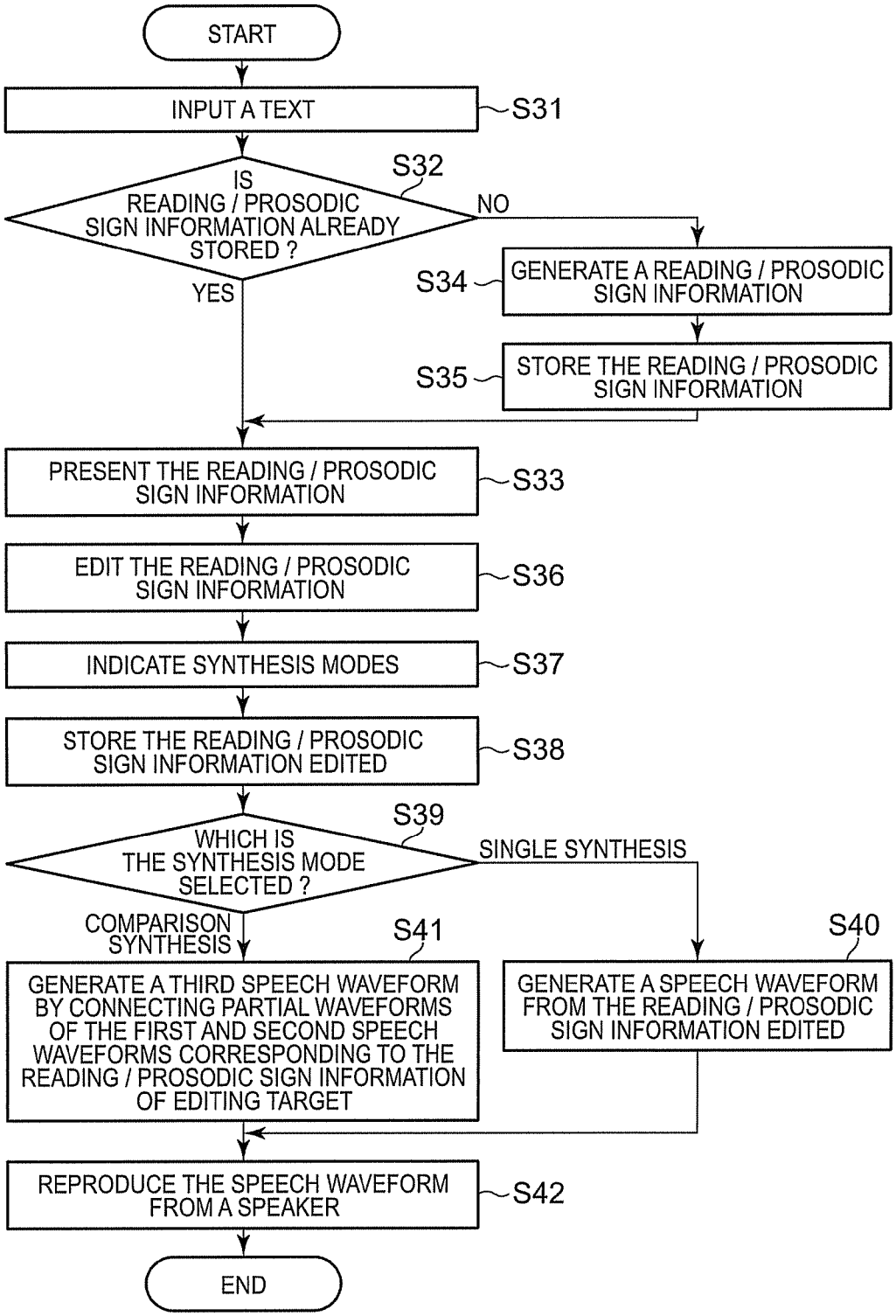
FIG. 3 is a flow chart of processing of the apparatus in FIG. 1.

FIG. 3 is a flow chart of processing of the apparatus for editing speech synthesis according to the first embodiment. First, the text input unit 101 inputs a text as a synthesis target from the keyboard of the operation unit 204 (S31). Next, the reading/prosodic sign generation unit 108 branches processing by deciding whether reading/prosodic sign information (generated from the text) is already stored in the phonemic and prosodic information storage unit 109 (S32). If the information is stored (Yes at S32), processing is forwarded to S33. If the information is not stored (No at S32), processing is forwarded to S34.

At S34, the reading/prosodic sign generation unit 108 performs morphological analysis/syntactic analysis/pose estimation to the text, and generates reading/prosodic sign information. Then, the reading/prosodic sign generation unit 108 correspondingly stores the reading/prosodic sign information and the text into the phonetic and prosodic information storage unit 109 (S35).

At 833, the phonemic and prosodic information editing unit 102 acquires the reading/prosodic sign information and the text from the phonetic and prosodic information storage unit 109, and presents them to a user. At S36, the user edits the reading/prosodic sign information presented by the phonemic and prosodic information editing unit 102. Next, at S37, the user indicates a synthesis mode to generate a speech waveform. In the first embodiment, two kinds of the synthesis mode, i.e., "single synthesis" and "comparison synthesis", are selectively used. The single synthesis is a mode to singly listen to a speech waveform of the reading/prosodic sign information of post-editing. On the other hand, the comparison synthesis is a mode to comparatively listen to two speech waveforms of the reading/prosodic sign information of pre-editing and post-editing.

At S38, the phonemic and prosodic information editing unit 102 additionally stores the reading/prosodic sign information (edited) in correspondence with the text into the phonemic and prosodic information storage unit 109.

At S39, processing is branched based on the synthesis mode indicated by the user at S37. In case of the synthesis mode "single synthesis" at S39, a speech waveform is generated from the reading/prosodic sign (edited) stored in the phonemic and prosodic information storage unit 109 (S40), and reproduced from the speaker 107 (S42). On the other hand, in case of the synthesis mode "comparison synthesis" at S39, processing is forwarded to S41.

At S41, the speech synthesis unit 104 generates a first speech waveform from the reading/prosodic sign information of pre-editing, and a second speech waveform from the reading/prosodic sign information of post-editing. Furthermore, by connecting two partial waveforms corresponding to the reading/prosodic sign information edited in the first and second speech waveforms, the speech synthesis unit 104 generates a third speech waveform. The third speech waveform is reproduced from the speaker 107 (S42).

Figure 4:
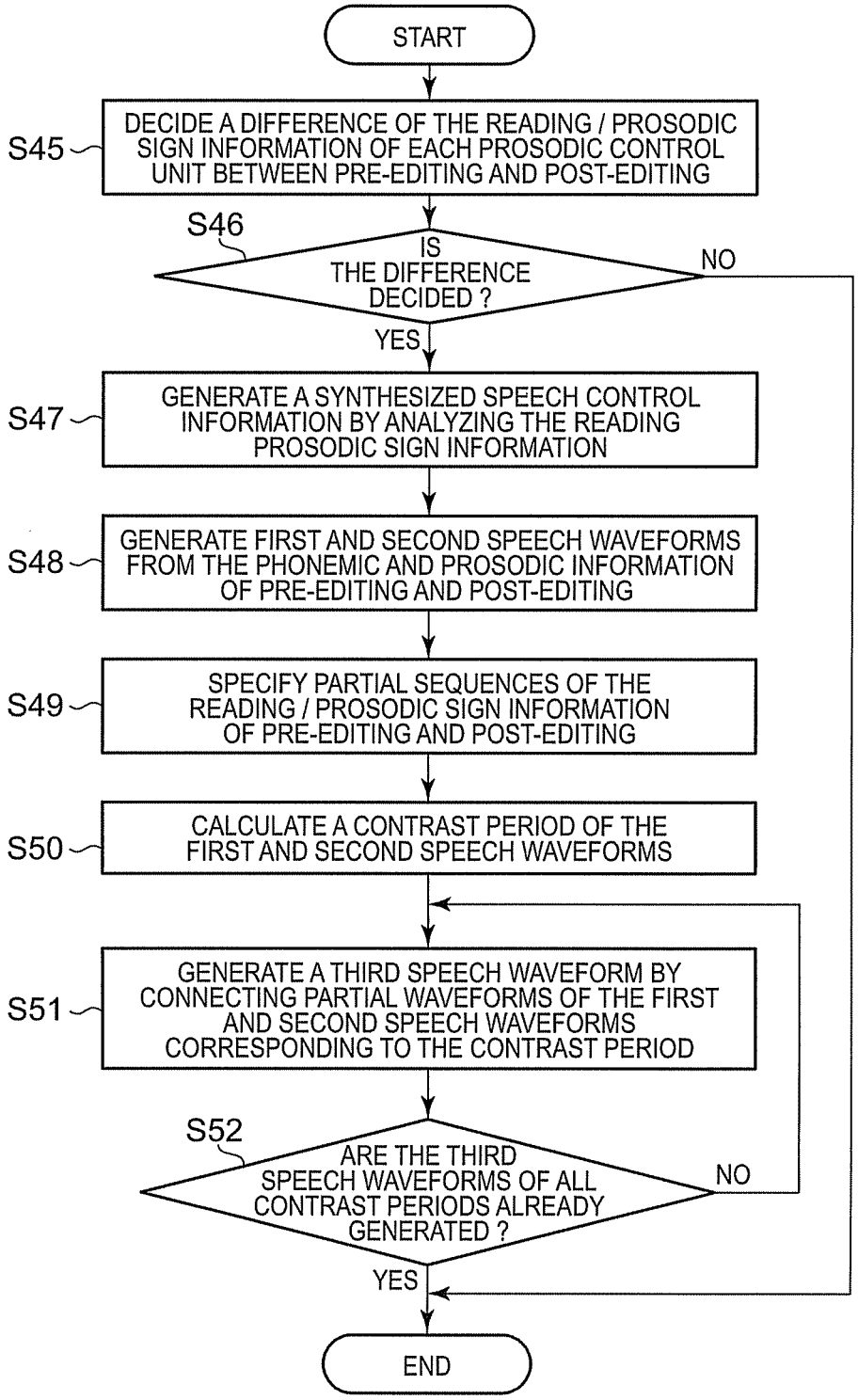
FIG. 4 is a flow chart of detail processing of S41 in FIG. 3.

Next, by referring to a flow chart of FIG. 4, detail processing of S41 is explained. First, the contrast period calculation unit 105 compares reading/prosodic sign information of pre-editing to reading/prosodic sign information of post-editing for each prosodic control unit. In this case, the reading/prosodic sign information of pre-editing and the reading/prosodic sign information of post-editing are stored in the phonemic and prosodic information storage unit 109. Then, the contrast period calculation unit 105 decides whether a difference occurs in a pair of corresponding prosodic control units between the reading/prosodic signs of pre-editing and post-editing (S45). In order to search corresponding two prosodic control units between the reading/prosodic signs of pre-editing and post-editing, optimal path search in dynamic programming is used.

At S46, processing is branched based on decision result of S45. If a difference occurs in a pair of corresponding prosodic control units between the reading/prosodic signs of pre-editing and post-editing (Yes at S46), processing is forwarded to S47. If the difference does not occur (No at S46), processing is completed without generation of the third speech waveform.

At S47, the synthesized speech control information generation unit 110 analyzes reading/prosodic sign information of pre-editing and post-editing (stored in the phonemic and prosodic information storage unit 109), and generates synthesized speech control information. The synthesized speech control information includes at least information to specify a speech waveform corresponding to each prosodic control unit, for example, duration of reading/prosodic sign information.

Next, the speech synthesis unit 104 generates a first speech waveform from phonemic and prosodic information (reading/prosodic sign information and synthesized speech control information) of pre-editing, and a second speech waveform from phonemic and prosodic information (reading/prosodic sign information and synthesized speech control information) of post-editing (S48).

At S49, the contrast period calculation unit 105 specifies a partial sequence including a prosodic control unit decided to occur the difference at S45 in reading/prosodic sign information of pre-editing and post-editing. As to specifying of the partial sequence in the reading/prosodic sign information of pre-editing and post-editing, detail processing using a concrete example is explained afterwards.

Next, the contrast period calculation unit 105 calculates a contrast period of the first and second waveforms from partial sequence (specified at S49) of the reading/prosodic sign information of pre-editing and post-editing (S50). In this case, in order to calculate the contrast period, duration of the reading/prosodic sign information (generated at S47) is used. Concretely, by assigning duration to the reading/prosodic sign information, a start position and an end position of a speech waveform corresponding to the partial sequence (editing target) are specified. Moreover, if a plurality of partial sequences is specified at S49, a plurality of contrast periods is calculated. For example, if two partial sequences are specified, two contrast periods such as "a first period between $100_{msec}$ and $200_{msec}$ in the first speech waveform, a second period between $110_{msec}$ and $220_{msec}$ in the second speech waveform", or "a first period between $300_{msec}$ and $400_{msec}$ in the first speech waveform, a second period between $320_{msec}$ and $430_{msec}$ in the second speech waveform".

Next, the contrast speech generation unit 106 connects a first partial waveform of the first speech waveform to a second partial waveform of the second speech waveform, and generates a third speech waveform (S51). In this case, the first partial waveform corresponds to a first contrast period, and the second partial waveform corresponds to a second contrast period. The first and second contrast periods are calculated by the contrast period calculation unit 105.

For example, if the contrast period is "a first period between $100_{msec}$ and $200_{msec}$ in the first speech waveform, a second period between $110_{msec}$ and $220_{msec}$ in the second speech waveform", a partial waveform extracted from a period including at least the first period is connected to a partial waveform extracted from a period including at least the second period. As a result, a third speech waveform is generated. In this case, a silent period approximately having $500_{msec}$ length may be inserted between two partial waveforms.

Last, at S52, as to all contrast periods calculated at S50, it is decided whether generation of the third speech waveform is completed. If the generation of the third speech waveform is not completed (No at S52), processing is returned to S51. On the other hand, the generation of the third speech waveform is completed (Yes at S52), processing is forwarded to S42, and the third speech waveform is reproduced from the speaker 107. Moreover, if a plurality of contrast periods is calculated and a plurality of third speech waveforms is generated at S51, the plurality of third speech waveforms can be continually reproduced at a predetermined interval (For example, $500_{msec}$).

(Concrete Example)

Next, operation of processing flow of FIGS. 3 and 4 is explained using a concrete example. Moreover, in this concrete example, assume that the phonemic and prosodic information storage unit 109 stores nothing at start timing.

Figure 5:
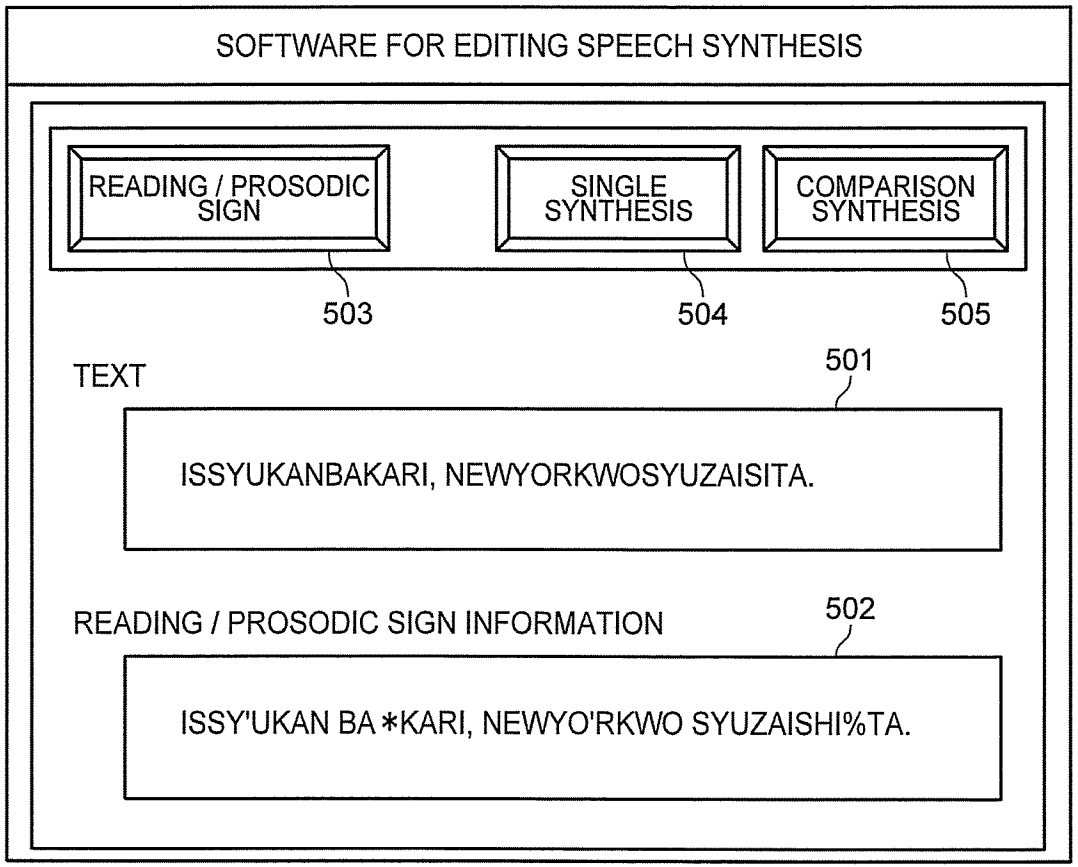
FIG. 5 is a schematic diagram of a user interface according to the first embodiment.

At S31, the text input unit 101 inputs a text "ISSYUKANBAKARI, NEWYORKWOSYUZAISHITA." into a text input column 501 of a user interface shown in FIG. 5. In this case, "ISSYUKANBAKARI, NEWYORKWOSYUZAISHITA." is Japanese in the Latin alphabet (Romaji). Then, in order to indicate generation of reading/prosodic sign information, a user pushes a button 503 to generate reading/prosodic sign.

At S32, processing is forwarded to S33, because the phonemic and prosodic information storage unit 109 does not store reading/prosodic sign information of this text.

At S33, the reading/prosodic sign generation unit 108 performs morphological analysis/syntactic analysis/pose length estimation to the text, and generates reading/prosodic sign information "[ISSY'UKAN]-[ ]-[BA*KARI]-[,]-[NEWYO'RKWO]-[ ]-[SYUZAISHI%TA]-[.]". In this case, a period surrounded by a parenthesis ([ ]) is one prosodic control unit. As to an accent phrase, its reading is declared by the Latin alphabet, and a position and a strength of accent are declared by a single quotation (') and an asterisk (*) respectively. Furthermore, (%) represents a silent syllable. A boundary of accent phrase is declared by a space comma (,), a colon (,) and a period (.).

At S33, the text "ISSYUKANBAKARI, NEWYORKWOSYUZAISHITA." and the reading/prosodic sign information "[ISSY'UKAN]-[ ]-[BA*KARI]-[,]-[NEWYO'RKWO]-[ ]-[SYUZAISHI%TA]-[.]" are stored into the phonemic and prosodic information storage unit 109 correspondingly.

At S36, the phonemic and prosodic information editing unit 102 acquires a first reading/prosodic sign information "[ISSY'UKAN]-[ ]-[BA*KARI]-[,]-[NEWYO'RKWO]-[ ]-[SYUZAISHI%TA]-[.]", and displays it on a column 502 of reading/prosodic sign information shown in FIG. 5.

Next, at S36, as to three prosodic control units reading/prosodic sign information "[ISSY'UKAN]-[ ]-[BA*KARI]" displayed on the column 502, assume that the user directly edits the text representing a boundary of accent phrase and a position of the accent via the keyboard of the operation unit 204. After editing, assume that the reading/prosodic sign information is "[ISSYUKANBA*KARI]-[,]-[NEWYO'RKWO]-[ ]-[SYUZAISHI%TA]-[.]".

At S37, by pushing a comparison synthesis button 505 in FIG. 5, the user selects "comparison synthesis" mode to comparatively listen to speech waveforms generated from partial sequences of the reading/prosodic sign information of pre-editing and post-editing. The partial waveforms represent "pre-editing: [ISSY'UKAN]-[ ]-[BA*KARI], post-editing: [ISSYUKANBA*KARI]". Moreover, if the user selects "single synthesis" mode to listen to only speech waveform generated from the reading/prosodic sign information of post-editing, the user pushes a single synthesis button 504 in FIG. 5.

Figure 6:
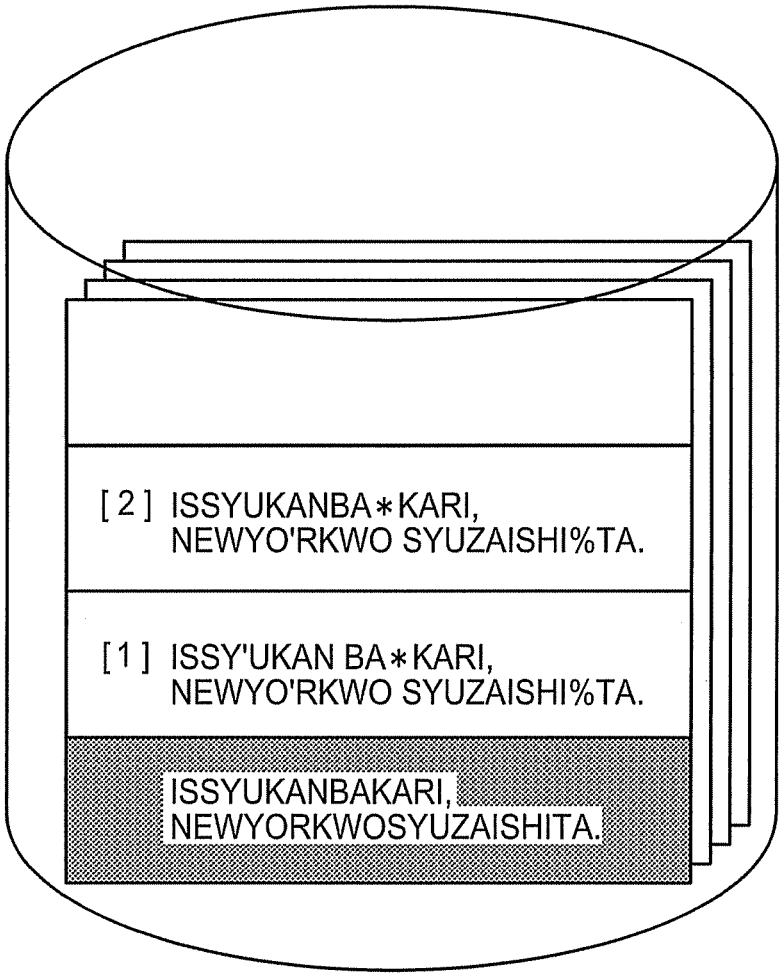
FIG. 6 is a schematic diagram of reading/prosodic sign information stored in a phonemic and prosodic information storage unit in FIG. 1.

At S38, as shown in FIG. 6, the phonemic and prosodic information editing unit 102 adds the reading/prosodic sign information (after editing) to a stack of the phonemic and prosodic information storage unit 109.

At S39, processing is forwarded to S41, because the user has selected "comparison synthesis" as a synthesis mode.

Figure 7:
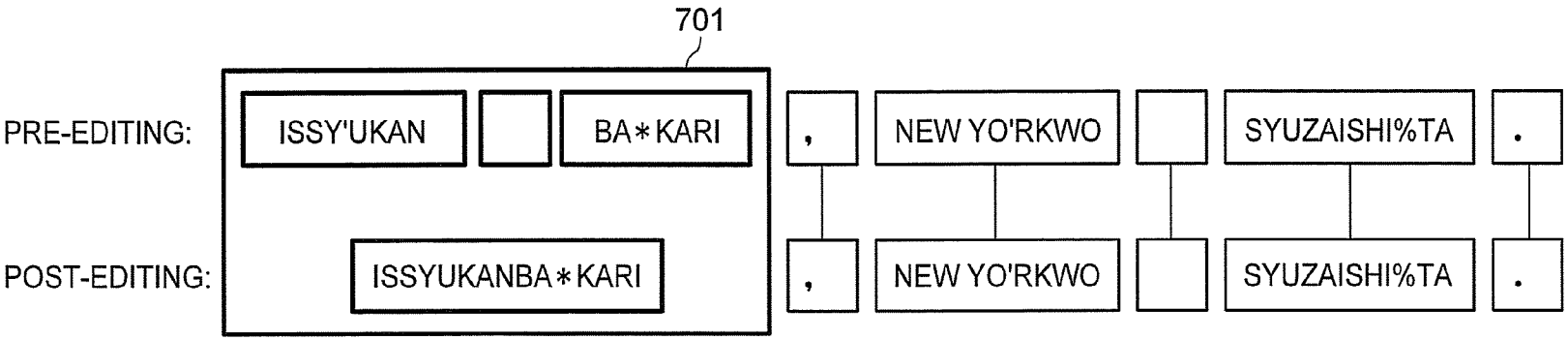
FIG. 7 is one example of the reading/prosodic sign information according to the first embodiment.

At S45, the contrast period calculation unit 105 compares each prosodic control unit of reading/prosodic sign information of pre-editing "[ISSY'UKAN]-[ ]-[BA*KARI]-[,]-[NEWYO'RKWO]-[ ]-[SYUZAISHI%TA]-[.]" to a corresponding prosodic control unit of reading/prosodic sign information "[ISSYUKANBA*KARI]-[,]-[NEWYO'RKWO]-[ ]-[SYUZAISHI%TA]-[.]", and decides whether a difference between corresponding two prosodic control units occurs. In order to search corresponding two prosodic control units before and after editing, optimal path search in dynamic programming is used. As shown in FIG. 7, the difference occurs between reading/prosodic sign information of pre-editing "[ISSY'UKAN]-[ ]-[BA*KARI]" and reading/prosodic sign information of post-editing "[ISSYUKANBA*KARI]".

At S46, processing is forwarded to S47, because the difference occurs in a pair of corresponding prosodic control units between reading/prosodic sign information of pre-editing and post-editing.

At S47, the synthesized speech control information generation unit 110 analyzes the reading/prosodic sign information of pre-editing and post-editing, and generates synthesized speech control information such as a fundamental frequency and duration of reading/prosodic sign information. Next, at S48, the speech synthesis unit 48 converts phonemic and prosodic information of pre-editing and post-editing to first and second speech waveforms respectively.

At S49, the contrast period calculation unit 105 specifies a partial sequence of reading/prosodic sign information of pre-editing and post-editing. The partial sequence includes a prosodic control unit decided to occur the difference at S45. In an example of FIG. 7, a prosodic control unit of post-editing "[ISSYUKANBA*KARI]" decided to occur the difference is a partial sequence of post-editing, and "[ISSY'UKAN]-[ ]-[BA*KARI]" corresponding thereto is a partial sequence of pre-editing. In FIG. 7, a portion surrounded by a focus 701 represents the partial sequences of pre-editing and post-editing specified by the contrast period calculation unit 105.

Figure 8A:
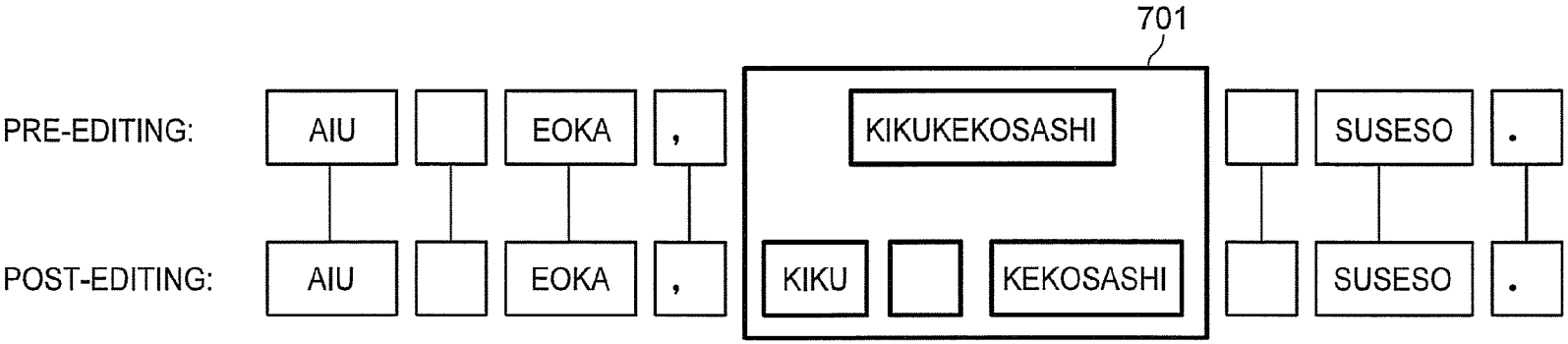
FIGS. 8A and 8B are another example of the reading/prosodic sign information according to the first embodiment.

Moreover, as shown in FIG. 8A, if a plurality of prosodic control units each having the difference continues, in reading/prosodic sign information of pre-editing and post-editing, the plurality of prosodic control units ([KIKU], [ ], [KEKOSASHI]) surrounded by prosodic control units ([,], [ ]) not having the difference is regarded as one group, and set to a partial sequence of post-editing. Furthermore, in the same way, as a partial sequence of pre-editing, a prosodic control unit [KIKUKEKOSASHI] surrounded by ([,], [ ]) is set.

Figure 8B:
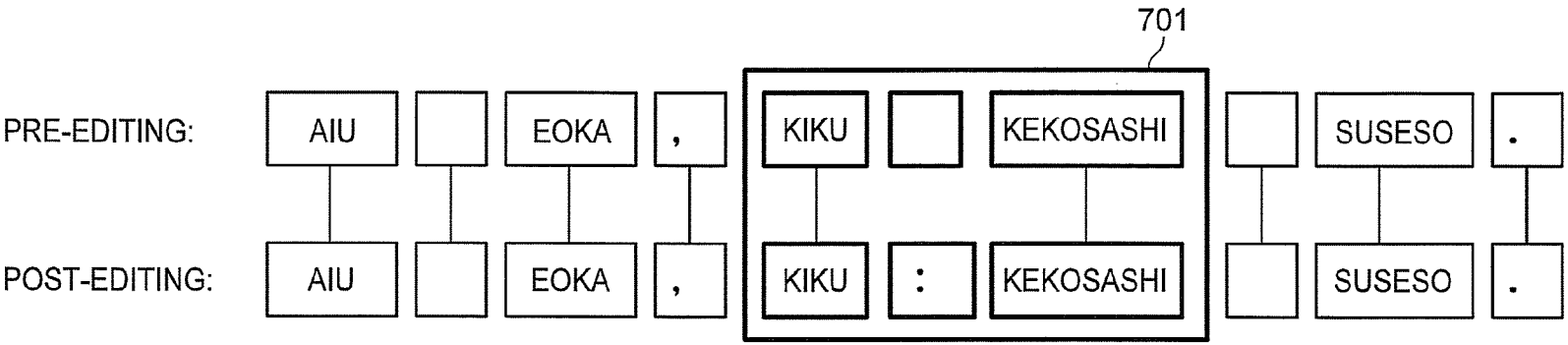

Furthermore, as shown in FIG. 8B, if a prosodic control unit having the difference is a boundary ([:]) of accent phrase, prosodic control units adjacent to this prosodic control unit can be included in partial sequences of pre-editing and post-editing. As a result, by the third speech waveform explained afterwards, change of pose length of boundary of accent phrase and change of fundamental frequency can be comparatively listened.

Figure 9A:
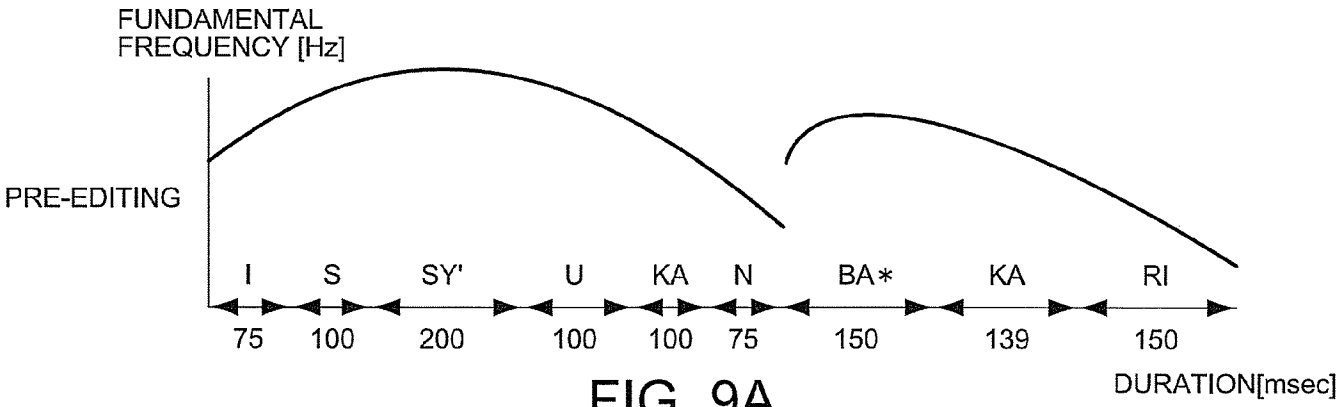
FIGS. 9A and 9B are one example of synthesized speech control information according to the first embodiment.
Figure 9B:
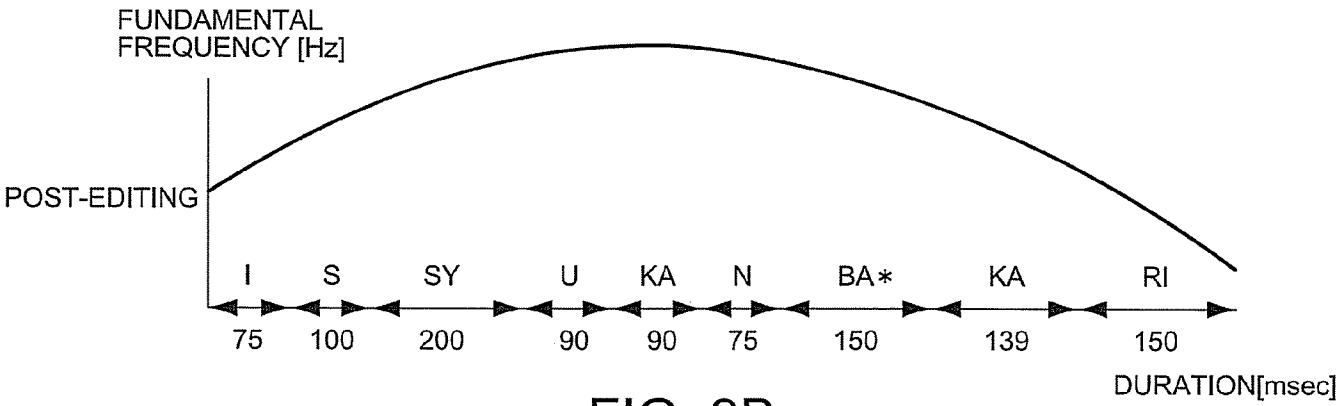

At S50, the contrast period calculation unit 105 calculates a contrast period of the first speech waveform and the second speech waveform from partial sequences of reading/prosodic sign of pre-editing and post-sequences (specified at S49). In order to calculate the contrast period, duration of reading/prosodic sign information (generated by the synthesized speech control information generation unit 110) is used. FIG. 9 shows duration and fundamental frequency of reading/prosodic sign information corresponding to a partial sequence of pre-editing "[ISSY'UKAN]-[ ]-[BA*KARI]". In this example, a start position of the contrast period of the first speech waveform corresponding to the partial sequence of pre-editing is $0_{msec}$ because [I] is the head letter. Furthermore, the sum of duration ($75_{ms}$, $100_{ms}$, $200_{ms}$, $100_{ms}$, $100_{ms}$, $75_{ms}$, $150_{ms}$, $139_{ms}$, $150_{ms}$) of each reading/prosodic information is $1089_{ms}$. Accordingly, an end position of the contrast period is $1089_{ms}$ from the start position. By above-mentioned processing, the contrast period of the first speech waveform is "a period between $0_{msec}$ and $1089_{msec}$". In the same way, as to a partial sequence of post-editing "[ISSYUKANBA*KARI]", a contrast period of the second speech waveform corresponding thereto is calculated as "a period between $0_{msec}$ and $1069_{msec}$".

Figure 10A:
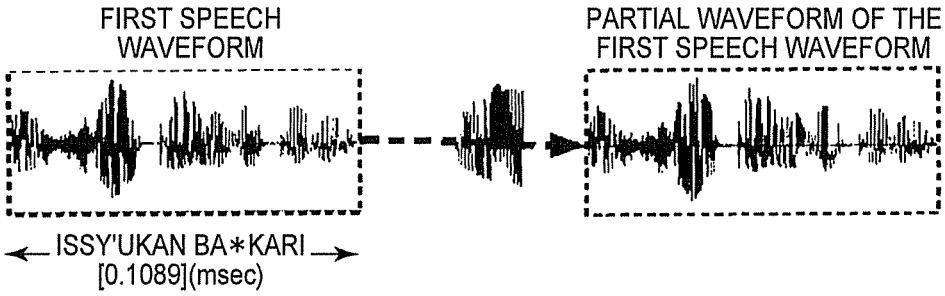
FIGS. 10A and 10B are one example of speech waveforms according to the first embodiment.
Figure 10B:
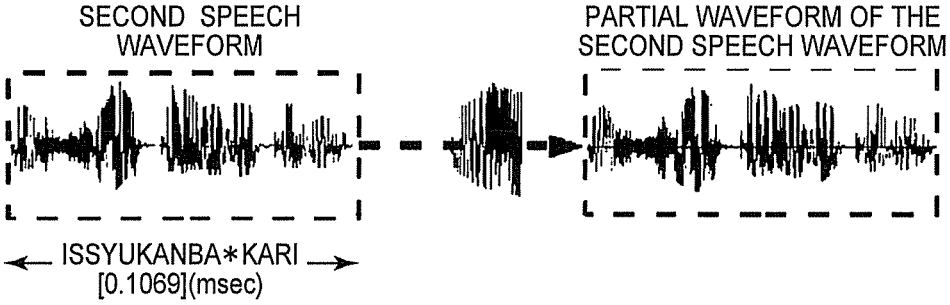
Figure 11A:
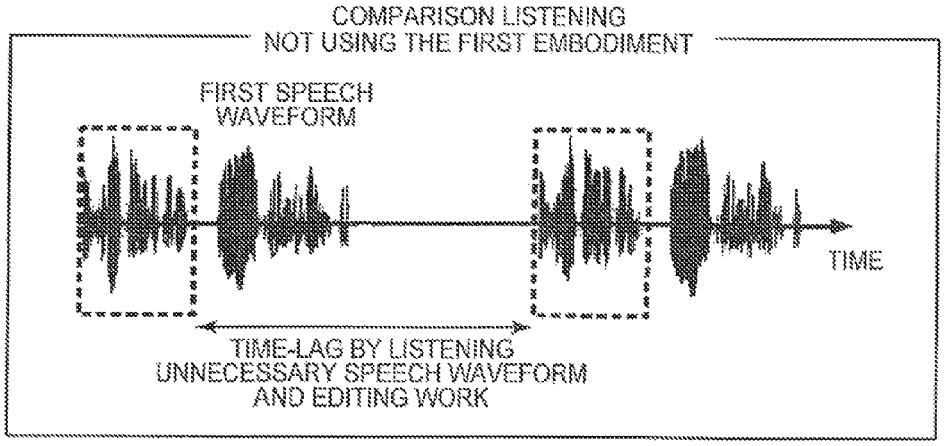
FIGS. 11A and 11B are schematic diagrams of comparison listening according to the first embodiment.
Figure 11B:
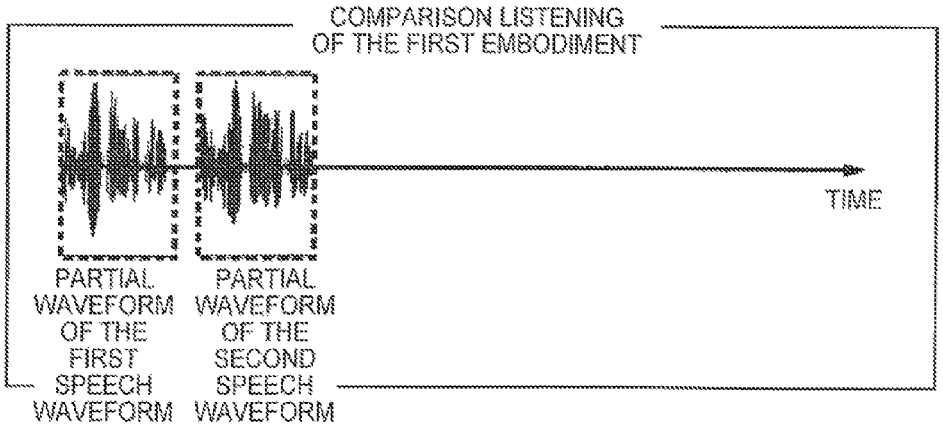

At S51, as shown in FIGS. 10A and 10B, the contrast speech generation unit 106 segments a partial waveform between $0_{msec}$ and $1089_{msec}$ of the first speech waveform, and a partial waveform between $0_{msec}$ and $1069_{msec}$ of the first speech waveform. Then, two partial waveforms are connected by inserting a silent period having $500_{msec}$ between them, and a third speech waveform is generated. Last, at S42, the third speech waveform is reproduced from the speaker 107. Briefly, as to phonemic and prosodic information edited by a user, speech waveforms of pre-editing and post-editing are connected and reproduced. Accordingly, as shown in FIGS. 11A and 11B, in comparison listening of the first embodiment, the user's listening of unnecessary speech waveforms and time-lag by editing work can be deleted.

(Effect)

As mentioned-above, in the apparatus for editing speech synthesis according to the first embodiment, by connecting partial waveforms of the first and second speech waveforms corresponding to the partial sequence (editing target) of the phonemic and prosodic information, the third speech waveform is output. Accordingly, the user can continually listen to speech waveforms of pre-editing and post-editing. As a result, the user can correctly confirm a difference of the speech waveforms caused by the user's editing work.

(The First Modification)

Figure 12:
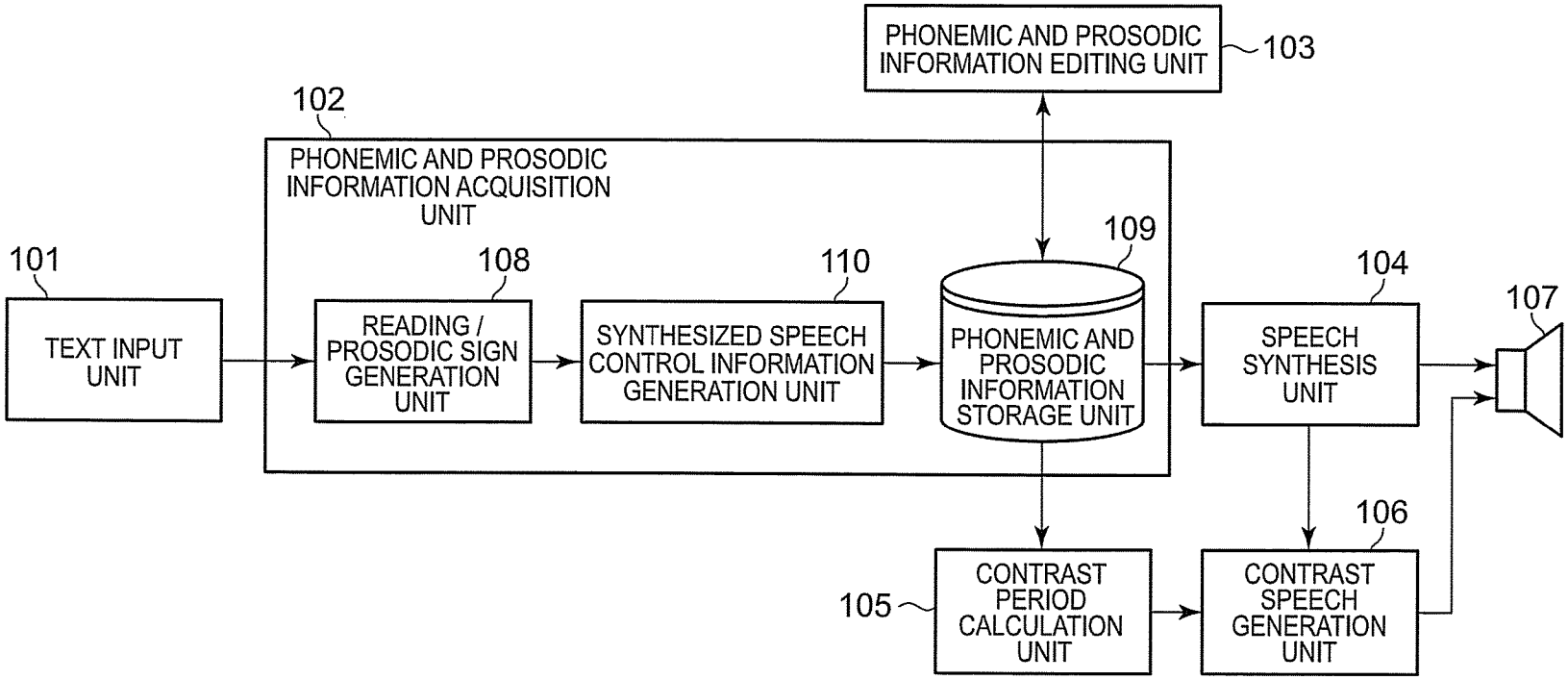
FIG. 12 is a block diagram of an apparatus for editing speech synthesis according to a first modification of the first embodiment.

In the first embodiment, among the phonemic and prosodic information, reading/prosodic sign information is the editing target. However, by setting a component shown in FIG. 12, synthesized speech control information (such as a fundamental frequency pattern and duration) generated by the synthesized speech control information generation unit 110 may be the editing target.

Figure 13:
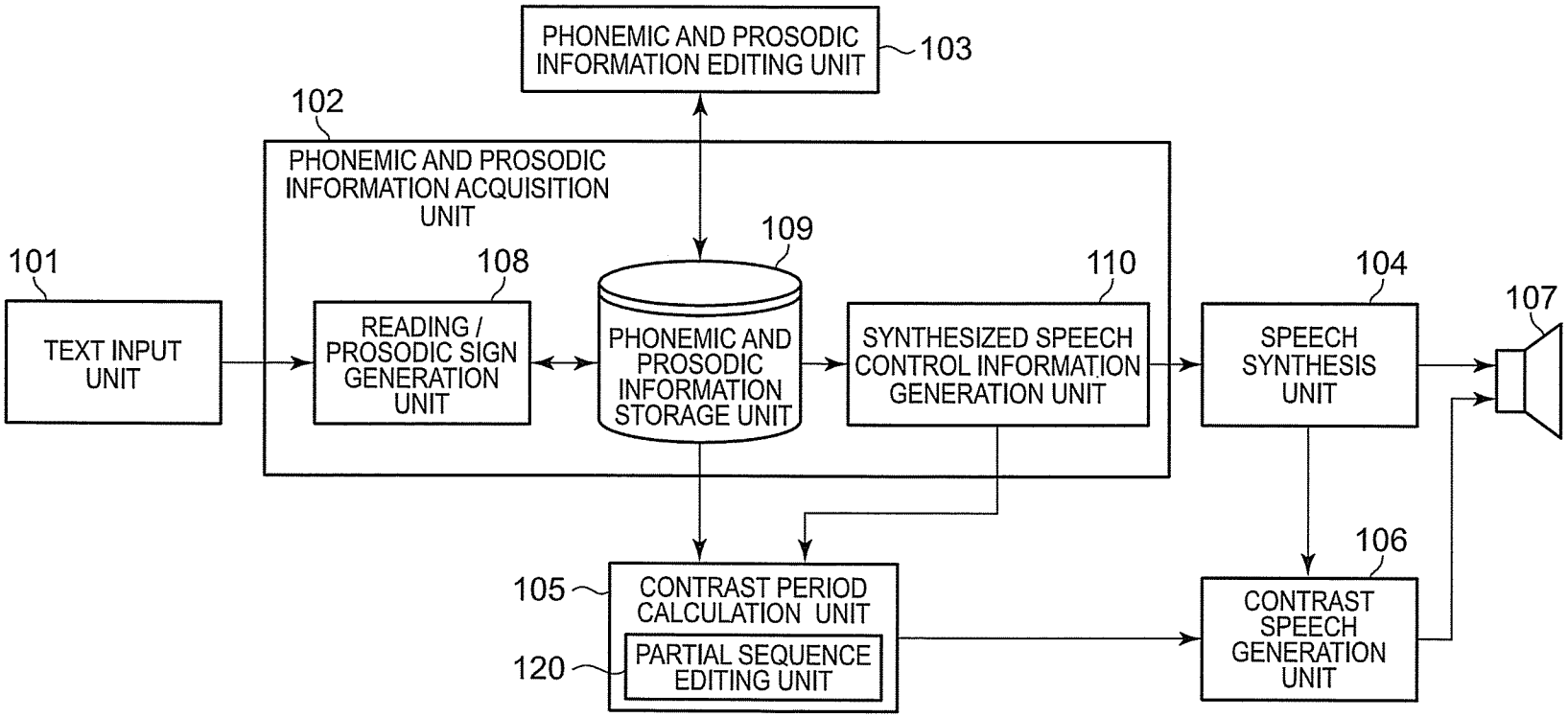
FIG. 13 is another block diagram of the apparatus for editing speech synthesis according to the first modification.

Furthermore, as shown in FIG. 13, a partial sequence editing unit 120 to edit a partial sequence may be set into the contrast period calculation unit 105. In this case, as to a partial sequence (pre-editing: [ISSY'UKAN]-[ ]-[BA*KARI], post-editing: [ISSYUKANBA*KARI]) of reading/prosodic sign information, the user can edit as (pre-editing: [ISSY'UKAN]-[ ]-[BA*KARI]-[,]-[NEWYO'RKWO], post-editing: [ISSYUKANBA*KARI]-[,]-[NEWYO'RKWO]). Briefly, by setting the partial sequence editing unit 120, the user can adjust a range of speech waveform to be comparatively listened.

(The Second Modification)

In the first embodiment, editing of phonemic and prosodic information in Japanese is described. However, language of the editing target is not limited to Japanese. For example, as to editing of phonemic and prosodic information of European language such as English, a position and a strength of syllable where stress positions in word, or a boundary of accent phrase, may be edited.

Figure 14:
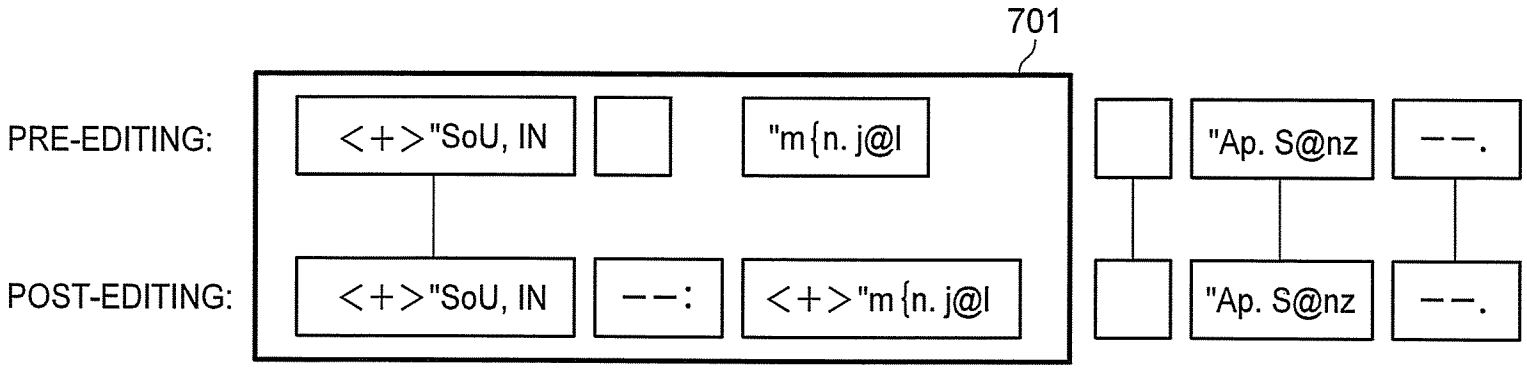
FIG. 14 is one example of reading/prosodic sign information according to a second modification of the first embodiment.

For example, FIG. 14 shows one example that phonemic and prosodic information (reading/prosodic sign information) of English "Showing Manual Options." is edited. In FIG. 14, a boundary of accent phrase is changed from "[ ]" (no pose) to "[--:]" (short pose), and a strength of accent phrase ("Manual" in text) is changed from middle "["m{n.j@l]" to strong "[<+>"m{n.j@l]". In this case, the contrast period calculation unit 105 specifies a part surrounded by a focus 701 in FIG. 14 as a partial sequence of pre-editing and post-editing. As a result, the user can continually listen to speech waveforms of pre-editing and post-editing corresponding to "Showing Manual".

Furthermore, as to editing of phonemic and prosodic information of tone language such as Chinese, a tone (four tones) of each syllable may be edited.

(The Third Modification)

In the first embodiment, the third speech waveform is continually reproduced in order of a partial waveform of the first speech waveform (pre-editing), and a partial waveform of the second speech waveform (post-editing). However, the third speech waveform may be continually reproduced in order of a partial waveform of the second speech waveform (post-editing), and a partial waveform of the first speech waveform (pre-editing).

The Fourth Embodiment

While a speech waveform is being outputted from the speaker 107, the contrast speech generation unit 106 can display information representing that the speech waveform is which of a partial waveform of the first speech waveform and a partial waveform of the second speech waveform on an information display unit. As the information display unit, a display 207 is used.

Figure 15A:
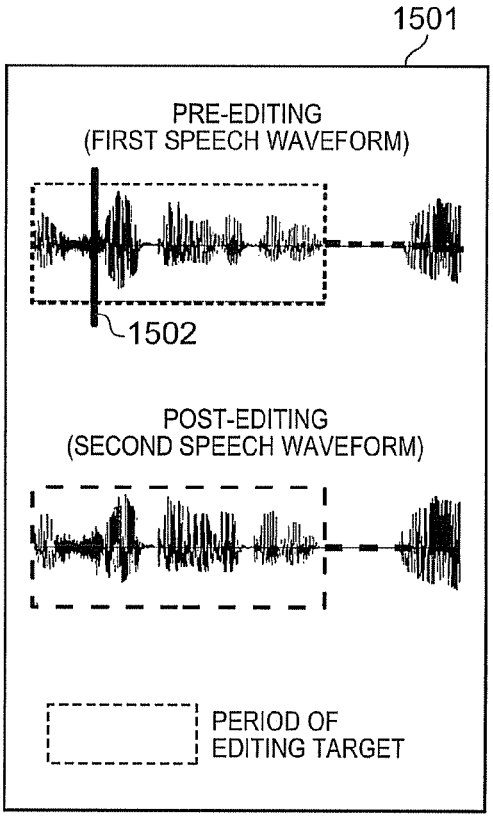
FIGS. 15A and 15B are one example of information display according to a fourth modification of the first embodiment.
Figure 15B:
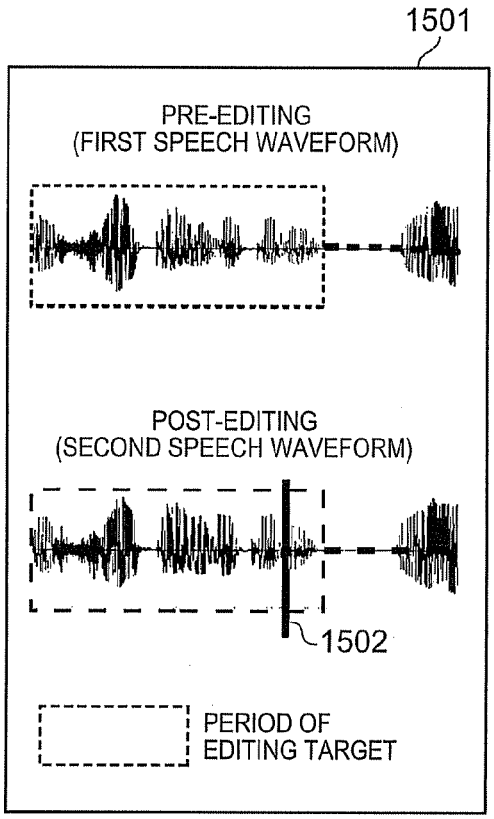

FIG. 15A shows a screen 1501 on the display 207, in which the first and second speech waveforms are displayed. In FIG. 15A, a bar 1502 represents a position of a speech waveform being outputted. In this example, a partial waveform of the first speech waveform is being outputted (reproduced from the speaker 107). Furthermore, FIG. 15B shows an example that a partial waveform of the second speech waveform is being outputted.

Figure 16:
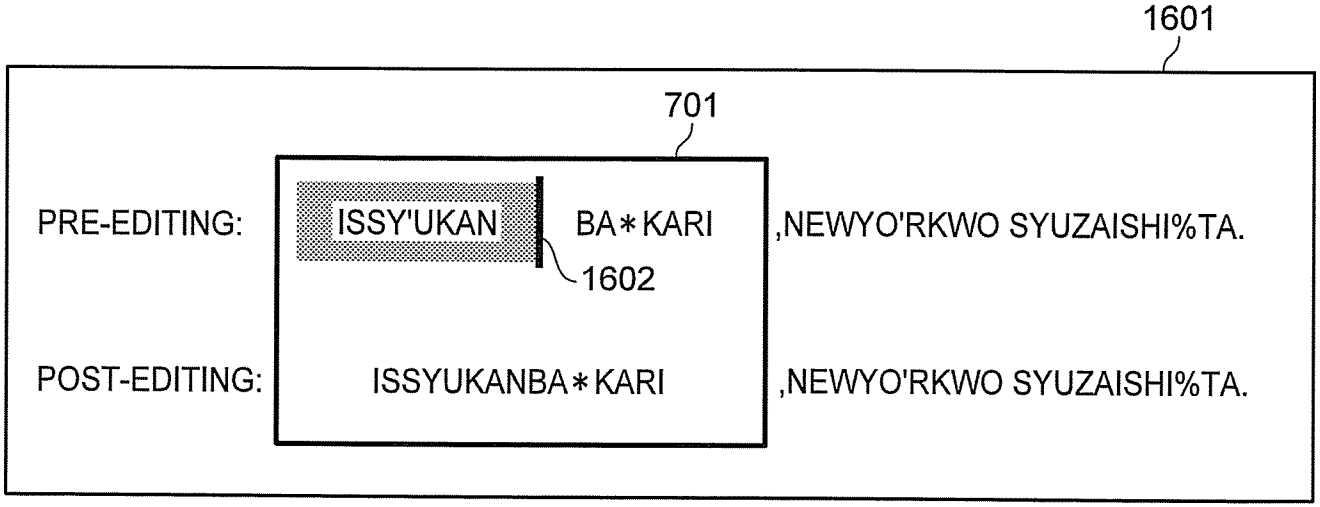
FIG. 16 is another example of information display according to the fourth modification.

In addition to this, as shown in FIG. 16, information can be displayed using reading/phonemic sign information of pre-editing and post-editing. In FIG. 16, a bar 1602 represents a position of reading/phonemic sign information corresponding to a speech waveform being outputted. Furthermore, a text such as "a speech waveform of pre-editing is being reproduced" may be displayed on the display 207. Moreover, a position of a speech waveform being outputted (by the contrast speech generation unit 106) can be specified using duration of each reading/prosodic sign.

In this way, in the apparatus of the forth modification, the contrast speech generation unit 106 can display information representing that a speech waveform (being outputted) is which of a partial waveform of the first speech waveform and a partial waveform of the second speech waveform on the information display unit. Accordingly, the user can easily decide whether a speech being presently listened is pre-editing one or post-editing one.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for editing speech synthesis, comprising:

an acquisition unit, executed by a computer using a program stored in a memory device, configured to analyze a text, and to acquire a phonemic and prosodic information to synthesize a speech corresponding to the text;

a display that displays the phonemic and prosodic information;

an editing unit, executed by the computer, configured to edit at least a part of the phonemic and prosodic information displayed on the display;

a speech synthesis unit, executed by the computer, configured to convert the phonemic and prosodic information in which the part is not edited to a first speech waveform, and to convert the phonemic and prosodic information in which the part is edited to a second speech waveform;

a period calculation unit, executed by the computer, configured to specify a partial sequence corresponding to the part not edited in the phonemic and prosodic information, and the part edited in the phonemic and prosodic information respectively, and to calculate a contrast period corresponding to the partial sequence in the first speech waveform and the second speech waveform respectively;

a speech generation unit, executed by the computer, configured to generate an output waveform by connecting a first partial waveform and a second partial waveform, the first partial waveform being the contrast period of the first speech waveform, the second partial waveform being the contrast period of the second speech waveform; and a speaker that reproduces the output waveform.

2. The apparatus according to claim 1, wherein the speech generation unit inserts a silent period having a predetermined length between the first partial waveform and the second partial waveform in the output waveform.

3. The apparatus according to claim 1, wherein the acquisition unit comprises a reading/prosodic sign generation unit configured to generate a reading sign and a prosodic sign by analyzing the text, and a synthesized speech control information generation unit configured to generate a synthesized speech control information by analyzing the reading sign and the prosodic sign, and the editing unit edits at least one of the reading sign, the prosodic sign and the synthesized speech control information, or a combination thereof.

4. The apparatus according to claim 3, wherein the period calculation unit calculates the contrast period by using a duration included in the synthesized speech control information.

5. The apparatus according to claim 4, wherein the period calculation unit comprises a partial sequence editing unit configured to edit the partial sequence, and calculates the contrast period corresponding to the partial sequence edited by the partial sequence editing unit.

6. The apparatus according to claim 1, further comprising: wherein the display displays an information representing which of the first partial waveform and the second partial waveform is being outputted by the speaker.

7. A method for editing speech synthesis, comprising:

analyzing, by a computer using a program stored in a memory device, a text;

acquiring, by the computer, a phonemic and prosodic information to synthesize a speech corresponding to the text;

displaying, by the computer, the phonemic and prosodic information via a display;

editing, by the computer, at least a part of the phonemic and prosodic information displayed on the display;

converting, by the computer, the phonemic and prosodic information in which the part is not edited to a first speech waveform;

converting, by the computer, the phonemic and prosodic information in which the part is edited to a second speech waveform;

specifying, by the computer, a partial sequence corresponding to the part not edited in the phonemic and prosodic information, and the part edited in the phonemic and prosodic information respectively;

calculating, by the computer, a contrast period corresponding to the partial sequence in the first speech waveform and the second speech waveform respectively;

generating, by the computer, an output waveform by connecting a first partial waveform and a second partial waveform, the first partial waveform being the contrast period of the first speech waveform, the second partial waveform being the contrast period of the second speech waveform; and reproducing, by the computer, the output waveform via a speaker.

8. A non-transitory computer readable medium for causing a computer to perform a method for editing speech synthesis, the method comprising:

analyzing, by the computer using a program stored in a memory device, a text;

acquiring, by the computer, a phonemic and prosodic information to synthesize a speech corresponding to the text;

displaying, by the computer, the phonemic and prosodic information via a display;

editing, by the computer, at least a part of the phonemic and prosodic information displayed on the display;

converting, by the computer, the phonemic and prosodic information in which the part is not edited to a first speech waveform;

converting, by the computer, the phonemic and prosodic information in which the part is edited to a second speech waveform;

specifying, by the computer, a partial sequence corresponding to the part not edited in the phonemic and prosodic information, and the part edited in the phonemic and prosodic information respectively;

calculating, by the computer, a contrast period corresponding to the partial sequence in the first speech waveform and the second speech waveform respectively;

generating, by the computer, an output waveform by connecting a first partial waveform and a second partial waveform, the first partial waveform being the contrast period of the first speech waveform, the second partial waveform being the contrast period of the second speech waveform; and reproducing, by the computer, the output waveform via a speaker.

* * * * *